US006251841B1

(12) United States Patent
Koizumi et al.

(10) Patent No.: US 6,251,841 B1
(45) Date of Patent: Jun. 26, 2001

(54) GREASE COMPOSITION

(75) Inventors: Hideki Koizumi; Atsushi Yokouchi; Kenichi Iso; Michiharu Naka; Toshiaki Endo; Atsushi Shibayama, all of Kanagawa (JP)

(73) Assignees: NSK Ltd.; Kyodo Yushi Co., Ltd., both of Tokyo (JP)

( * ) Notice: Subject to any disclaimer, the term of this patent is extended or adjusted under 35 U.S.C. 154(b) by 0 days.

(21) Appl. No.: 09/280,678

(22) Filed: Mar. 29, 1999

(30) Foreign Application Priority Data

Mar. 30, 1998 (JP) ..... 10-084133

(51) Int. Cl.[7] ..... C10M 135/10

(52) U.S. Cl. ..... 508/390; 508/413; 508/500; 508/530; 508/551

(58) Field of Search ..... 508/390, 413, 508/500, 530, 551

(56) References Cited

U.S. PATENT DOCUMENTS 4,201,681 * 5/1980 Lipinsk ..... 252/389
4,897,210 * 1/1990 Newsoroff ..... 508/261
5,059,336 * 10/1991 Naka et al. ..... 508/310

* cited by examiner

*Primary Examiner*—Margaret Medley
*Assistant Examiner*—Cephia D. Toomer
(74) *Attorney, Agent, or Firm*—Sughrue, Mion, Zinn, Macpeak & Seas, PLLC

(57) ABSTRACT

The present invention provides a grease composition excellent in both rust-proofing properties and safety. The grease composition comprises a lubricating base oil and a thickener, and further comprises a lipophilic organic inhibitor, a nonionic surface active agent and a hydrophilic organic inhibitor selected from the group consisting of lanolin fatty acid derivative and alkanolamine derivative modified with a hydrophilic group each in an amount of from 0.1 to 10% by weight based on the total weight of said grease composition.

10 Claims, No Drawings

GREASE COMPOSITION

FIELD OF THE INVENTION

The present invention relates to a grease composition. Particularly, the present invention relates to a grease composition having improved rust-proofing properties. More particularly, the present invention relates to a grease composition for use in lubricated parts such as rolling bearing liable to rusting due to invasion of water, saline or brine from the road as occurring with automobile electric parts during running or invasion of cooling water in the iron industry.

BACKGROUND OF THE INVENTION

A rolling bearing or other parts which are liable to rusting are provided with a proper seal or other mechanical countermeasures to prevent the entrance of rusting substances. In automobiles, for example, bearings are disposed at positions which are not directly exposed to muddy water or mudguards are provided to prevent the entrance of rusting substances. Further, a dust-proofing seal plate is used to prevent the entrance of rusting substances into the interior of bearings.

However, a rolling bearing cannot be completely sealed because of its mechanism and thus normally is lubricated with a wetting grease provided with rust-proofing properties.

The provision of a grease with rust-proofing properties is normally accomplished by adding a material called rust preventive to the grease. As such a rust preventive there is widely used a chromate, nitrite, molybdate, tungstate or the like, particularly an inorganic passivator made of sodium salt thereof from the standpoint of its high performance. In particular, sodium nitrite is most effective and thus is most widely used. However, such an inorganic passivator is water-soluble and thus can hardly be dispersed in an oil-based material such as grease. Thus, a grease comprising a surface active agent in combination with such an inorganic passivator is commercially available as well.

Further, an organic rust preventive is used as well. Such an organic rust preventive is also called lipophilic organic inhibitor. Representative examples of such an organic rust preventive include sulfonate and carboxylate. However, this lipophilic organic inhibitor cannot itself exhibit rust-proofing properties so strong as the foregoing inorganic passivator and leaves something to be desired in rust-proofing properties particularly when exposed to saline. Thus, there is provided a grease comprising such a lipophilic organic inhibitor in combination with an inorganic passivator and optionally a surface active agent. This grease comprising an oil-soluble organic inhibitor in combination with an organic passivator and optionally a surface active agent exhibits better rust-proofing properties than a grease comprising an inorganic passivator alone.

However, sodium nitrite, which is a representative example of inorganic passivator, exhibits excellent rust-proofing properties but can affect animals and plants under some working conditions. It is thus said that the use of sodium nitrite should be avoided if possible.

On the other hand, stricter rust-proofing properties have been required of greases in recent years.

In the automobile industry, for example, as the use of automobiles diversifies as in running by the sea shore and running on the road sprinkled with salt for prevention of freezing, stricter rust-proofing properties have been required of greases. In the iron industry, too, improved rust-proofing properties have been required of greases, because the molding powder, which is used in continuous casting facilities, was changed to that which causes a part thereof to be dissolved in the cooling water, thereby accelerating rusting on bearings mounted in rolling mill.

In recent years, not only rust-proofing properties but also safety have been required of greases. However, there are no greases satisfying both the two requirements.

SUMMARY OF THE INVENTION

It is therefore an object of the present invention to provide a grease which exhibits excellent rust-proofing properties and safety.

The foregoing object of the present invention will become more apparent from the following detailed description and examples.

The present invention has been worked out as a result of extensive studies of solution to the foregoing problems. The present invention concerns a grease composition comprising a lubricating base oil and a thickener, characterized in that there are incorporated a lipophilic organic inhibitor, a nonionic surface active agent and a hydrophilic organic inhibitor selected from the group consisting of lanolin fatty acid derivative and alkanolamine derivative modified with a hydrophilic group each in an amount of from 0.1 to 10% by weight based on the total weight of said grease composition.

In accordance with the present invention, the use of a specific hydrophilic organic inhibitor in combination with a lipophilic organic inhibitor and a nonionic surface active agent makes it possible to obtain a grease composition having rust-proofing properties equivalent to or higher than that of a grease composition comprising sodium nitrite, which has heretofore been said to have excellent rust-proofing properties.

The combination of a lipophilic organic inhibitor, a hydrophilic organic inhibitor and a surface active agent in the grease composition according to the present invention brings forth a higher rust-proofing effect than that of each of these inhibitors. This is a so-called synergistic effect. In this mechanism, each of these inhibitors acts to help the other ingredients to act effectively in addition to its own rust-proofing properties. The surface active agent used herein allows water, which causes rusting, to be taken into the grease base oil as an emulsion to inhibit the exchange between the lipophilic inhibitor and corrosive materials contained in water on the surface of metal. Further, the hydrophilic organic inhibitor can be taken into the emulsion, making it possible to further inhibit rusting.

Accordingly, the combination of a lipophilic organic inhibitor, a hydrophilic organic inhibitor and a surface active agent according to the present invention makes it possible to provide a grease having rust-proofing properties far better than that expected with the single use of these inhibitors and equivalent to or better than that of inorganic passivator.

DETAILED DESCRIPTION OF THE INVENTION

The grease composition according to the present invention will be further described hereinafter.

The grease composition according to the present invention comprises as rust preventives a lipophilic organic inhibitor and a hydrophilic organic inhibitor in combination.

The lipophilic organic inhibitor to be used herein is not specifically limited. Any lipophilic organic inhibitor which has heretofore been incorporated in greases may be used.

Examples of such a lipophilic organic inhibitor include compounds having a polar group such as carboxylic acid, carboxylate, sulfonate and amine. Such a lipophilic organic inhibitor is said to be adsorbed by the surface. of metal (e.g., inner ring, outer ring and rolling elements of bearing) with its polar group arranged toward the surface of metal to form a rust-proofing film.

Particularly preferred among these lipophilic organic inhibitors is an organic sulfonate. This organic sulfonate is represented by the general formula $RSO_3.M$. Examples of $RSO_3$, which is the acid moiety of the salt, include petroleum sulfonic acid, and dinonylnaphthalenesulfonic acid. Examples of M, which is the alkali moiety of the salt, include metal such as Ba, Ca, Zn, Pb, Na and Li, and amine such as $NH_4$ and $H_2N(CH_2)_2NH_2$.

These lipophilic organic inhibitors may be used singly or in proper combination.

The hydrophilic organic inhibitor is taken into an emulsion. The hydrophilic organic inhibitor employable herein may be selected from the group consisting of lanolin fatty acid derivative and alkanolamine derivative modified with a hydrophilic group. Specific examples of the hydrophilic organic inhibitor will be given below.

Examples of lanolin fatty acid derivative modified with a hydrophilic group include lanolin fatty acid polyethylene glycol ester, lanolin fatty acid amine ester, and lanolin fatty acid alkanolamide.

Examples of alkanolamine derivative modified with a hydrophilic group include salts of a dibasic acid (e.g., dodecanoic diacid and sebacic acid) or an acid (e.g., boric acid) with an alkanolamine such as diethanolamine, aminotetrazole, or diethyl aminoethanol.

These hydrophilic organic inhibitors may be used singly or in proper combination.

The present invention involves the use of the foregoing organic lipophilic organic inhibitor and the foregoing hydrophilic organic inhibitor in combination with a nonionic surface active agent.

As such a nonionic surface active agent there is preferably used one having a hydrophilic-lipophilic balance (HLB) of from 1.5 to 9. Specific examples of the nonionic surface active agent employable herein include ester compounds such as glycerin fatty acid ester, polyglycerin fatty acid ester, sorbitan fatty acid ester, pentaerythritol fatty acid ester and polyoxyethylen fatty acid ester, and ether compounds such as polyoxyethylene alkyl phenyl ether. The HLB is described in detail, for example, in "Zenteiban Shin Kamenkasseizai Nyumon" (Completely Revised Edition of New Surface Active Agent Introduction) and "New Introduction to Surface Active Agents", edited by T. Fujimoto and published by Sanyo Chemical Industries, Ltd.

This nonionic surface active agent may be regarded as an organic inhibitor. However, the nonionic surface active agent itself exerts very little effect of preventing rusting as compared with the foregoing two organic inhibitors. Thus, the nonionic surface active herein contributes mainly to the dispersibility of the foregoing two organic inhibitors in a grease. Further, the selection of such a nonionic surface active agent makes it possible to keep a rust preventive film (system) on a metal surface electrically neutral.

The foregoing lipophilic organic inhibitor, hydrophilic organic inhibitor and nonionic surface active agent are incorporated in the grease composition each in an amount of from 0.1 to 10% by weight based on the total weight of the grease composition. If the content of each of these ingredients falls below 0.1% by weight, the resulting rust-proofing properties are insufficient. On the contrary, if the content of each of these ingredients exceeds 10% by weight, it affects the physical properties such as heat resistance and shear stability of the resulting grease to an extent such that the grease cannot be used over an extended period of time.

The mixing proportion of each of these ingredients is not specifically limited so far as it falls within the above defined range. In practice, however, it is most effective to use these ingredients in the same amount (by weight) because a synergistic effect developed by them can possibly promote the rust-proofing properties.

The present invention can apply regardless of the kind of lubricating base oil and thickener.

Examples of the lubricating base oil employable herein include ester-based synthetic oils such as mineral oil, diester and polyol ester, synthetic hydrocarbon oils such as poly-α-olefin and ether-based synthetic oils such as alkyldiphenylether.

Examples of the thickener employable herein include soap-based thickeners such a lithium soap, urea-based thickeners such as diurea, inorganic thickeners such as bentonite, and organic thickeners such as polytetrafluoroethylene (PTFE). Most preferred among these thickeners are urea-based thickeners. This is because urea-based thickeners exhibit an excellent shear stability and acoustic characteristics and give little consistency change while soap-based thickeners tend to soften the grease when the bearing rotates (when subject to shearing) to disadvantage and inorganic thickeners (bentonite) and organic thickeners (PTFE) originally do not exhibit good acoustic characteristics.

The content of the lubricating base oil and thickener in the grease composition are not limited in the present invention, but, for example, the content of the lubricating base oil is approximately from 60 to 98% weight and the content of the thickener is approximately from 2 to 30% by weight.

EXAMPLES

The grease composition according to the present invention will be further described in the following examples and comparative examples, but the present invention should not be construed as being limited thereto.

Examples 1–9; Comparative Examples 1–6; Reference Example 1

To a base grease (94 to 98 g) was added rust-proofing additives as set forth in Tables 1 to 3. The mixtures thus obtained were then kneaded in a triple roll mill to prepare test greases of examples and comparative examples. For all the examples except Example 7, all the comparative examples and the reference example, the foregoing base grease A was used. For Example 7, the following base grease B was used.

Base Grease A

Thickener: Diurea compound comprising tolylene diisocyanate, paratoluidine and octylamine Base oil: Mixture composed of alkyl diphenyl ether oil and pentaerythritol ester oil and having a dynamic viscosity of 77 cSt at 40° C.

Consistency: NLGI No. 2 grade

Base Grease B

Thickener: Lithium soap

Base oil: Mixture composed of pentaerythritol ester oil and diester oil and having a dynamic viscosity of 26 cSt at 40° C.

Consistency: NLGI No. 2 grade

Referring to the additives used, as sulfonates there were all used various commercially available metal salts of dinonylnaphthalenesulfonate. Referring to alkanolamine salt, alkanolamine salt A is a salt of dodecanoic diacid ($HOOC(CH_2)_{10}COOH$), sebacic acid and boric acid with diethanolamine while alkanolamine salt B is a salt of dodecanoic diacid and sebacic acid with aminotetrazole, diethanolamine and diethylaminoethanol. As lanolin fatty acid derivatives there were used lanolin fatty acid polyethylene glycol ester, lanolin fatty acid amine ester, and lanolin fatty acid alkanolamide.

As a reference grease composition there was prepared a test grease comprising sodium nitrite, which is an inorganic passivator, as a hydrophilic inhibitor incorporated in the base grease A along with a lipophilic organic inhibitor and a hydrophilic organic inhibitor.

The various test greases thus prepared were then subjected to rust prevention test in the following manner.

Rust Prevention Testing Method 2.4 g of the test grease was enclosed in a sealed deep groove ball bearing with a rubber seal (#6303) which was then subjected to running-in rotation at 1,800 rpm for 30 seconds. Thereafter, 0.5 cc of a 3 wt % saline was injected into the bearing which was then again subjected to running-in rotation at 1,800 rpm for 30 seconds. Subsequently, the bearing was allowed to stand in a thermo-hygrostat which had been kept at a temperature of 52° C. and a humidity of 100% RH for 24 hours, and then disassembled. The bearing surface was then observed for rusting. The evaluation was made in accordance with the following criterion. The results are set forth in Tables 1 to 3 below.

Evaluation (Visual)

#1 . . . No rusting

#2 . . . 3 or less small rust points

#3 . . . Greater or more rust points than #2

TABLE 1

| | Example 1 | Example 2 | Example 3 | Example 4 | Example 5 |
|---|---|---|---|---|---|
| Thickener | Urea | Urea | Urea | Urea | Urea |
| Lipophilic inhibitor/ added amount (g) | Barium sulfonate/ 1.0 g | Zinc sulfonate/ 1.0 g | Zinc sulfonate/ 1.0 g | Zinc sulfonate/ 1.0 g | Zinc sulfonate/ 1.0 g |
| Hydrophilic inhibitor/ added amount (g) | Alkanolamine salt A/ 1.0 g | Alkanolamine salt B/ 1.0 g | Lanolin fatty acid polyethylene glycol ester/ 1.0 g | Lanolin fatty acid amine ester/ 1.0 g | Lanolin fatty acid alkanolamide/ 1.0 g |
| Nonionic surface active agent/added amount (g)/ HLB | Sorbitan trioleate/ 1.0 g/ 3.0 | Sorbitan trioleate/ 1.0 g/ 3.0 | Sorbitan trioleate/ 1.0 g/ 3.0 | Sorbitan trioleate/ 1.0 g/ 3.0 | Sorbitan trioleate/ 1.0 g/ 3.0 |
| Evaluation of rust prevention test (3% saline, 52° C., 24 hr.) | #1 | #1 | #1 | #1 | #1 |

TABLE 2

| | Example 6 | Example 7 | Example 8 | Example 9 |
|---|---|---|---|---|
| Thickener | Urea | Lithium soap | Urea | Urea |
| Lipophilic inhibitor/ added amount (g) | Barium sulfonate/1.0 g | Barium sulfonate/1.0 g | Zinc sulfonate/1.0 g | Zinc sulfonate/2.0 g |
| Hydrophilic inhibitor/ added amount (g) | Alkanolamine salt A/1.0 g | Alkanolamine salt A/1.0 g | Lanolin fatty acid alkanolamide/0.5 g | Alkanolamine salt B/2.0 g |
| Nonionic surface active agent/added amount (g) HLB | Polyoxyethylene ester/1.0 g/8.4 | Sorbitan trioleate/1.0 g/3.0 | Sorbitan trioleate/0.5 g/3.0 | Sorbitan trioleate/2.0 g/3.0 |
| Evaluation of rust prevention test (3% saline, 52° C., 24 hr.) | #1 | #1 | #1 | #1 |

TABLE 3

| | Comparative Example 1 | Comparative Example 2 | Comparative Example 3 | Comparative Example 4 | Comparative Example 5 | Comparative Example 6 | Reference Example 1 |
|---|---|---|---|---|---|---|---|
| Thickener | Urea | Urea | Urea | Urea | Urea | Urea | Urea |
| Lipophilic inhibitor/ added amount (g) | Barium sulfonate/ 1.0 g | Zinc sulfonate/ 2.0 g | — | — | — | — | Zinc sulfonate/ 1.0 g |
| Hydrophilic inhibitor/ added amount (g) | — | Alkanol-amine salt A/ 1.0 g | Alkanol-amine salt A/ 2.0 g | Lanolin-fatty acid polethylene glycol ester/ 2.0 g | Lanolin-fatty acid amine ester/ 2.0 g | Lanolin-fatty acid alkanol amide/2.0 g | $NaNO_2$/ 1.0 g |
| Nonionic surface active agent/added amount (g) HLB | Sorbitan trioleate/ 2.0 g/3.0 | — | Sorbitan trioleate/ 1.0 g/3.0 | Sorbitan trioleate/ 1.0 g/3.0 | Sorbitan trioleate/ 1.0 g/3.0 | Sorbitan trioleate/ 1.0 g/3.0 | Sorbitan trioleate/ 1.0 g/3.0 |
| Evaluation of Rust prevention test (3% saline, 52° C., 24 hr.) | #2 | #3 | #3 | #3 | #3 | #3 | #1 |

As can be seen in the comparative examples, the lack of even one from the combination of lipophilic organic inhibitor, hydrophilic organic inhibitor and surface active agent causes remarkable deterioration of rust-proofing properties.

It can also be seen that the test greases of the various examples exhibit rust-proofing properties equivalent to that of the test grease of the reference example.

As mentioned above, in accordance with the present invention, the combination of a lipophilic organic inhibitor and specific hydrophilic organic inhibitor and nonionic surface active agent makes it possible to obtain rust-proofing properties equivalent to that of a grease composition comprising an inorganic passivator. Thus, a grease composition excellent in both rust-proofing properties and safety can be provided.

While the invention has been described in detail and with reference to specific embodiments thereof, it will be apparent to one skilled in the art that various changes and modifications can be made therein without departing from the spirit and scope thereof.

What is claimed is:

1. A grease composition comprising a lubricating base oil and a thickener, which further comprises:

(1) a lipophilic organic inhibitor, (2) a nonionic surface active agent, and (3) a hydrophilic organic inhibitor selected from the group consisting of lanolin fatty acid derivative and alkanolamine derivative each modified with a hydrophilic group, each in an amount of from 0.1 to 10% by weight based on the total weight of said grease composition.

2. The grease composition of claim 1, wherein the lipophilic organic inhibitor is a compound having a polar group.

3. The grease composition of claim 1, wherein the lipophilic organic inhibitor has at least one selected from the group consisting of carboxylic acid, carboxylates, sulfonates and amines.

4. The grease composition of claim 1, wherein the lipophilic organic inhibitor is an organic sulfonate represented by formula $RSO_3.M$, where $RSO_3$ represents petroleum sulfonic acid or dinonylnaphthalenesulfonic acid and M represents Ba, Ca, Zn, Pb, Na, Li, or an amine.

5. The grease composition of claim 1, wherein the hydrophilic organic inhibitor is at least one selected from the group consisting of lanolin fatty acid polyethylene glycol ester, lanolin fatty acid amine ester, and lanolin fatty acid alkanolamide as the lanolin fatty acid derivative modified with a hydrophilic group, and salts of dodecanoic diacid, sebacic acid or boric acid with diethanolamine or diethyl aminoethanol as the alkanolamine derivative modified with a hydrophilic group.

6. The grease composition of claim 1, wherein the nonionic surface active agent is one having a hydrophilic-lipophilic balance (HLB) of from 1.5 to 9.

7. The grease composition of claim 1, wherein the nonionic surface active agent is at least one selected from the group consisting of esters of fatty acid with glycerin, polyglycerin, sorbitan, pentaerythritol or polyoxyethylene as an ester compound, and polyoxyethylene alkyl phenyl ether as an ether compound.

8. The grease composition of claim 1, wherein the total amount of the lipophilic organic inhibitor, the nonionic surface active agent, and the hydrophilic organic inhibitor is from 2 to 6% by weight.

9. The grease composition of claim 1, wherein the amount of the lipophilic organic inhibitor is from 1 to 2% by weight, and the amount of the nonionic surface active agent and the hydrophilic organic inhibitor each is from 0.5 to 2% by weight.

10. The grease composition of claim 1, wherein the lipophilic organic inhibitor (1), the nonionic surface active agent (2), and the hydrophilic organic inhibitor (3) each is incorporated in the same amount by weight.

* * * * *